US006420638B2

(12) United States Patent
Teel

(10) Patent No.: US 6,420,638 B2
(45) Date of Patent: Jul. 16, 2002

(54) GUITAR NECK ASSEMBLY AND METHOD OF MANUFACTURING SAME

(75) Inventor: Timothy A. Teel, Lehighton, PA (US)

(73) Assignee: C.F. Martin Guitar Company, Nazareth, PA (US)

( * ) Notice: Subject to any disclaimer, the term of this patent is extended or adjusted under 35 U.S.C. 154(b) by 0 days.

(21) Appl. No.: 09/751,106

(22) Filed: Dec. 28, 2000

Related U.S. Application Data

(60) Provisional application No. 60/180,019, filed on Feb. 3, 2000.

(51) Int. Cl.[7] ..... G10D 3/00

(52) U.S. Cl. ..... 84/293; 84/298; 84/299; 84/307; 84/314 R

(58) Field of Search ..... 84/293, 314 R, 84/291, 298, 299, 307, 275

(56) References Cited

U.S. PATENT DOCUMENTS

| | | | | |
|---|---|---|---|---|
| 3,805,663 A | * | 4/1974 | Okuyawa | 84/293 |
| 4,103,583 A | * | 8/1978 | Takabayashi | 84/291 |
| 4,188,850 A | | 2/1980 | Kaman, II | 84/291 |
| 4,313,362 A | | 2/1982 | Lieber | 84/267 |
| 5,337,644 A | * | 8/1994 | Fishman et al. | 84/314 R |
| 5,406,874 A | | 4/1995 | Witchel | 84/291 |
| 5,461,958 A | | 10/1995 | Dresdner et al. | 84/267 |
| 5,952,592 A | | 9/1999 | Teel | 84/291 |
| 6,034,309 A | | 3/2000 | Teel et al. | 84/291 |

* cited by examiner

*Primary Examiner*—Shih-Yung Hsieh
(74) *Attorney, Agent, or Firm*—Howson and Howson

(57) ABSTRACT

A neck for an acoustic guitar made from a plywood material which is glued with and at least partially impregnated with a phenolic resin. The plywood neck is stronger and more durable than conventional neck structures and requires no further finishing steps during manufacture other than sanding and buffing. Preferably, a fingerboard made of a high pressure laminate material is adhesively secured to the neck. In addition, a bridge made of the same type of high pressure laminate as the fingerboard is preferably attached to the soundboard of the guitar body.

20 Claims, 3 Drawing Sheets

10
12
14
16
18
20
24
26
28
30
32
2
2

14
24
32
34
36
36

GUITAR NECK ASSEMBLY AND METHOD OF MANUFACTURING SAME

This application claims benefit of Provisional Application No. 60/180,019 filed Feb. 3, 2000.

FIELD OF THE INVENTION

The present invention relates to stringed instruments, such as, acoustic guitars, and more particularly, the present invention relates to a novel neck construction for an acoustic guitar.

BACKGROUND OF THE INVENTION

A typical acoustic guitar has a hollow body connected to a neck. The hollow body has a soundboard with a soundhole, a backboard spaced from the soundboard, and a shaped sidewall which extends between the soundboard and backboard. Typically, these components are constructed of choice pieces of wood in order to produce instruments of superior quality.

Prior art designs have attempted to improve upon the strength and durability of acoustic guitars without adversely affecting the playing qualities of the guitar. For example, U.S. Pat. No. 5,461,958 issued to Dresdner et al. and assigned to the assignee of the present application discloses an acoustic guitar assembly having a wooden soundboard with an improved soundboard bracing structure and an improved neck to body joint.

Acoustic guitar bodies have been manufactured from non-wooden high pressure laminate materials. For example, see U.S. Pat. No. 5,406,874 issued to Witchel which discloses an acoustic guitar constructed from relatively inexpensive, non-wooden materials. The hollow body of the guitar, including the sidewall, soundboard and baseboard, is constructed of sheets of synthetic resin laminates, such as, melamine impregnated resins impressed over phenolic kraft layers.

U.S. Pat. No. 5,952,592 which issued to Teel and which is assigned to the assignee of the present application provides another example of a guitar body made of high pressure laminate materials. U.S. Pat. No. 6,034,309 discloses a method of manufacturing a guitar body made of high pressure laminate materials. Such guitars made of non-wooden laminates provide an economic alternative for the purchaser of a high quality acoustic guitar, and due to dwindling wood resources, provide an ecologically-friendly alternative to traditional solid and laminated tonewoods.

The necks of high quality acoustic guitars, particularly those manufactured by the present assignee, are made of conventional wooden materials, such as mahogany. This is true even if the guitar body is made from high pressure laminate materials as disclosed by the above cited references. The exterior surface of the conventional wooden guitar neck requires numerous finishing steps. For example, a spray-on finish is applied to the neck to protect the wood and to provide it with a wanted appearance. In addition, a fingerboard is attached to the neck. The fingerboard is typically made of a relatively expensive material and requires an amount of labor and time for proper installation on the guitar neck.

Therefore, although the above-mentioned acoustic guitar assemblies accomplish their intended purposes, there is a need for a high quality, durable acoustic guitar which has an improved neck construction. The neck should be made from a relatively inexpensive material which does not require significant finishing processing during manufacture. In addition, the neck should have improved durability and strength and be capable of withstanding the forces created by the tensioned strings of the guitar.

OBJECTS OF THE INVENTION

With the foregoing in mind, a primary object of the present invention is to provide a high quality acoustic guitar which can be manufactured economically relative to traditional acoustic guitar models.

Another object of the present invention is to provide an acoustic guitar with a neck constructed of a relatively inexpensive material which does not adversely affect the tonal qualities of the guitar.

A further object of the present invention is to provide an acoustic guitar with a unique neck construction specifically designed for use with a non-wooden guitar body.

SUMMARY OF THE INVENTION

More specifically, the present invention provides a musical instrument having a body with a bridge, an elongate neck with a headstock, and strings under tension extending from the headstock to the bridge along the neck. The neck is made of a solid piece of machined plywood material that is glued with and at least partially impregnated with a phenolic resin.

According to another concept of the present invention, a method of manufacturing an acoustic guitar is provided. A solid piece of plywood material glued with and at least partially impregnated with a phenolic resin is machined into a guitar neck, and then the neck is sanded and buffed. The phenolic resin in the plywood material provides the neck which has been sanded and buffed with an appropriate finish. Thus, the requirement of additional finishing steps is eliminated.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
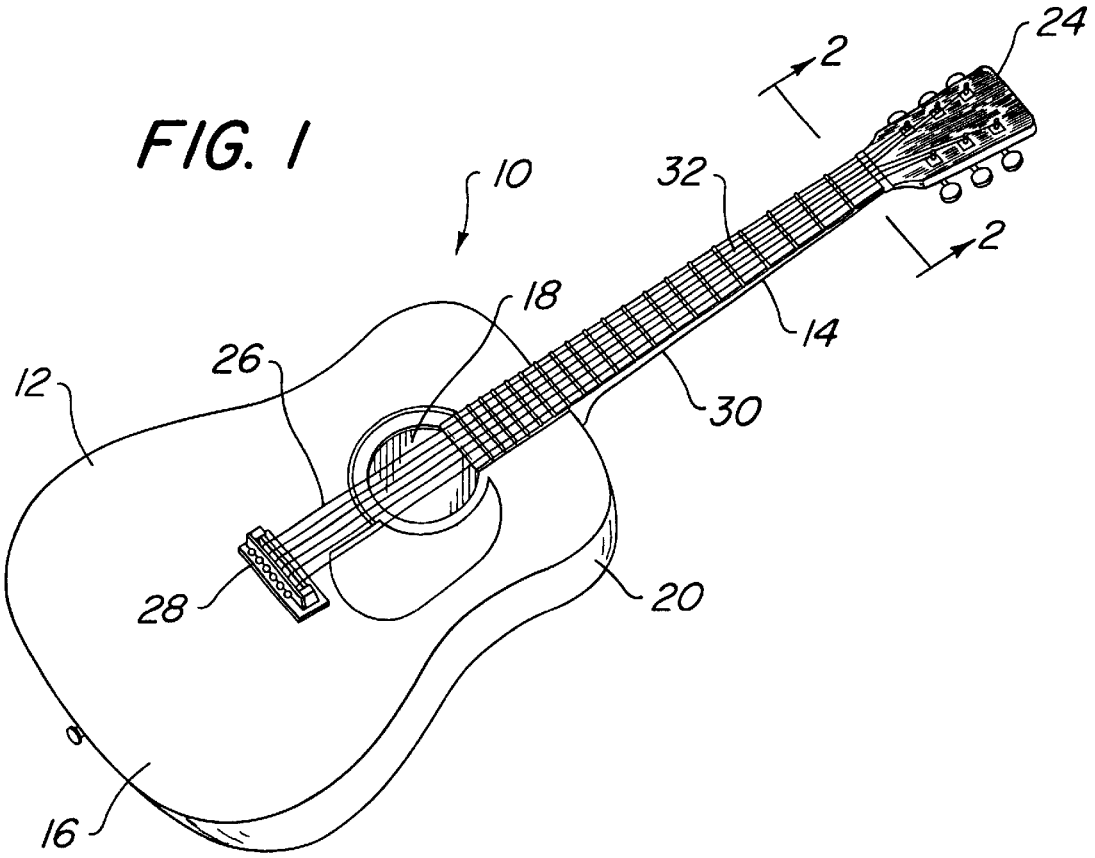
FIG. 1 is a perspective view of an acoustic guitar having a neck according to the present invention.

Referring now to the drawings, FIG. 1 illustrates an acoustic guitar 10 having a hollow body 12 and a neck 14. The body has a soundboard 16 with a circular soundhole 18. The soundboard 16 is connected to sidewall 20 which, in turn, is connected to a backboard 22. The neck 14 has a headstock 24, and strings 26 are strung from the headstock 24 in a direction along the neck 14, across the soundhole 18 and to a bridge 28 on the soundboard 16.

Preferably, the soundboard 16, backboard 22 and sidewall 20 are constructed of high pressure laminate materials such as those disclosed in U.S. Pat. No. 5,406,874 issued to Witchel, U.S. Pat. No. 5,952,592 issued to Teel and U.S. Pat. No. 6,034,309 issued to Teel et al. The disclosures of the three above listed patents are incorporated herein by reference.

The neck 14 of the present invention is constructed of a strong plywood material which is glued with and at least partially impregnated with a phenolic resin. Similar to a neck made of mahogany, a solid piece of the plywood material is machined into the wanted shape of the neck 14 including an elongate neck section 30 and a headstock 24. However, unlike mahogany necks, the plywood neck does not require the use of spray-on finishes and the like. Rather, the phenolic resin within the plywood material provides the neck with a finish which is aesthetically pleasing and long lasting. Therefore, after the neck 14 is machined, it merely requires sanding and buffing to achieve the finished product. In addition, the plywood neck is stronger and more durable than an identical shaped neck made from mahogany.

Examples of a plywood material which is glued with and partially impregnated with a phenolic resin are products sold under the brand names STRATABOND and COLORPLY. These materials consist of a plurality of plies of birch glued together and partially impregnated with phenolic resin. A preferred material has plies which are each about 1/16 of inch thick and which extend continuously in a parallel relationship with adjacent plies. Various colors of the material are available including wood-grain.

A fingerboard 32 is attached to the front face of the plywood neck 14, for instance, with a conventional wood glue, such as a glue with the brand name TITEBOND, and dowels 34. Preferably, the fingerboard 32 is a relatively inexpensive, thick, high pressure laminate material. For example, the material can be a high pressure laminate sold under the brand name MICARTA. The fingerboard 32 is preferably provided in black and has an appearance nearly identical to ebony. The advantages of utilizing a high pressure laminate fingerboard is that the high pressure laminate material is relatively inexpensive, easier to work with during assembly of the guitar, and has superior durability.

The above-disclosed neck construction can be utilized in any stringed instrument assembly including those having stringed instrument bodies constructed from choice pieces of wood or from non-wooden high pressure laminate materials.

Figure 2:
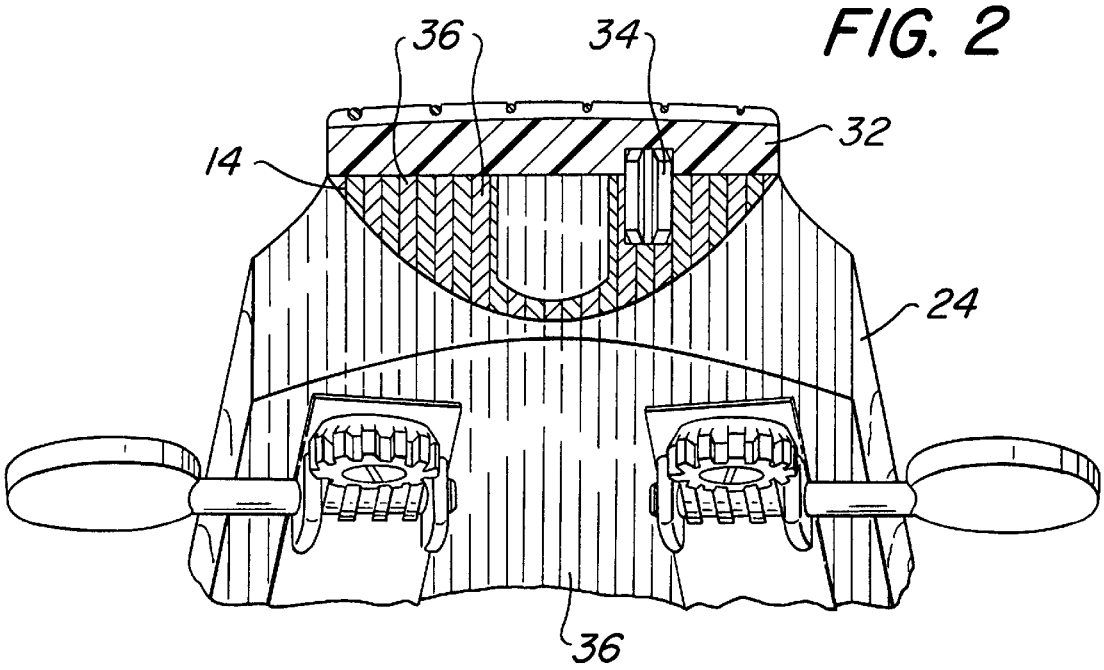
FIG. 2 is a cross-section view of the guitar neck of FIG. 1 taken along line 2—2.
Figure 3:
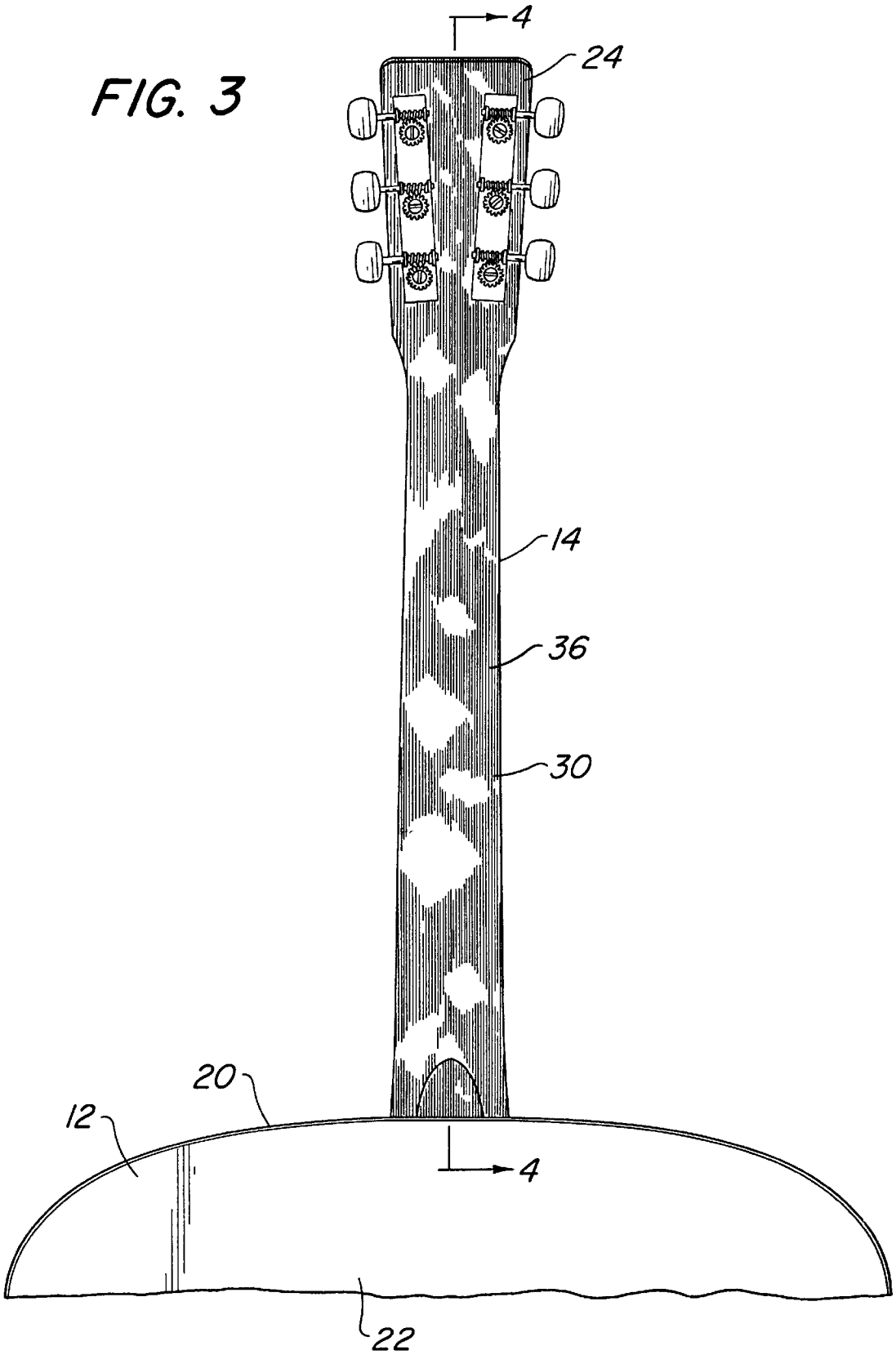
FIG. 3 is a bottom plan view of the guitar neck illustrated in FIG. 1.
Figure 4:
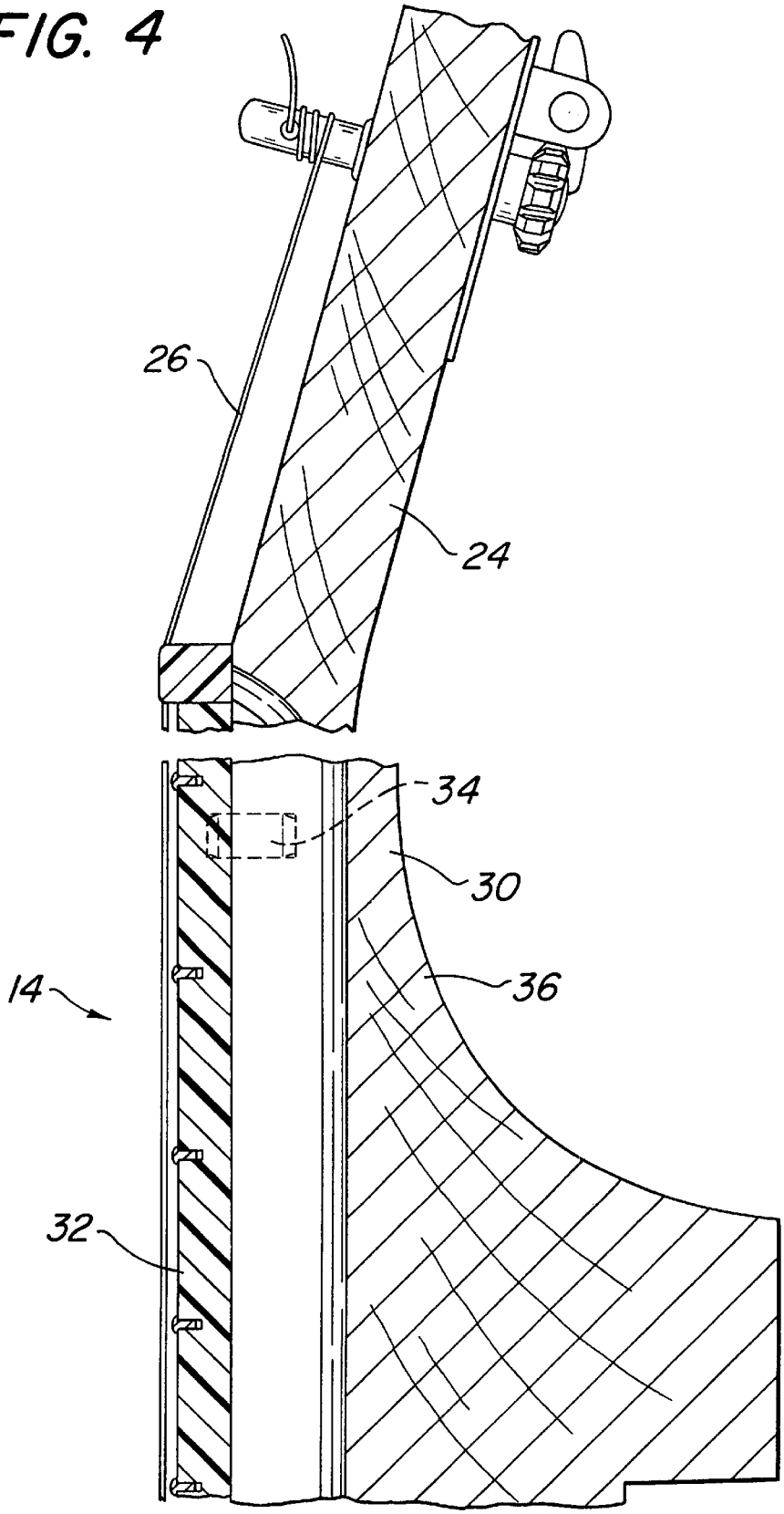
FIG. 4 is a cross-sectional view of the guitar neck of FIG. 3 taken along line 4—4.

One contemplated embodiment illustrated in the FIGS. 1–4 is an acoustic guitar 10 which has a high pressure laminate guitar body 12. Preferably, the plies 36 of the plywood neck 14 extend parallel to each other and perpendicularly to the plane of the fingerboard 32 as is best illustrated in FIG. 2. In addition, preferably the plies 36 extend continuously in the lengthwise direction of the neck 14 from the body-to-neck joint to the end of the headstock 24 as is best illustrated in FIG. 3. Thus, each ply 36 extends in a direction parallel to the strings 26 of the guitar 10.

Preferably, the bridge 28 of the guitar 10 is made of the same type of high pressure laminate material utilized to make the fingerboard 32. The bridge 28 can be provided in black, while the high pressure laminate guitar body 12 can be provided in any selected color.

The above described structural features facilitate ready manufacture and provide a durable acoustic guitar.

While a preferred embodiment of a neck construction for an acoustic guitar has been described, various modifications, alterations, and changes may be made without departing from the spirit and scope of the present invention as defined in the appended claims.

What is claimed is:

1. In an acoustic guitar having a body with a soundboard, a backboard spaced from the soundboard, a sidewall extending between and connecting the soundboard and backboard, and a neck extending from the body sidewall, the soundboard having a soundhole and an underside, and the soundboard, backboard and sidewall being made of synthetic resin laminate sheets, the improvement comprising:

a fingerboard adhesively secured to a front face of said neck adjacent strings strung on the acoustic guitar;

a bridge secured to the soundboard, said bridge and said fingerboard being made of a same type of high pressure laminate material; and said neck being made of a solid piece of plywood material glued with and at least partially impregnated with a phenolic resin, said plywood material being multiple glued together plies of wood capable of being cut into a desired neck shape including an integral headstock, and said plies being substantially parallel to each other and to said strings and extending substantially perpendicular to a plane common with said fingerboard.

2. An acoustic guitar according to claim 1, wherein each ply of said plywood is made of birch wood and is approximately 1/16 of an inch thick.

3. A method of manufacturing an acoustic guitar, comprising the steps of:

machining a solid piece of plywood material glued with and at least partially impregnated with a phenolic resin into a guitar neck; and sanding and buffing said guitar neck after said machining step;

whereby, upon sanding and buffing said guitar neck, said phenolic resin in said plywood material provides said neck with an appropriate finish thereby eliminating the requirement of any additional finishing steps.

4. A method according to claim 3, further comprising the step of securing a fingerboard made of a high pressure laminate to a front face of said neck.

5. A method according to claim 4, wherein said plies in said plywood material are substantially parallel with each other and to strings strung on the guitar, and wherein said plies are disposed substantially perpendicular to a plane common with said fingerboard and extend continuously throughout the length of the neck.

6. A method according to claim 5, further comprising the step of attaching a guitar body to said neck.

7. A method according to claim 6, further comprising the step of securing a bridge to said guitar body, wherein said bridge is made of a high pressure laminate material.

8. A method according to claim 7, wherein said guitar body is made of a non-wooden high pressure laminate material.

9. A method according to claim 8, wherein said plywood material is made of plies of birch wood glued together.

10. A method according to claim 9, wherein said plies are each about 1/16th of an inch thick.

11. A musical instrument comprising a body with a bridge, an elongate neck with a headstock, strings extending from said headstock to said bridge along said neck, and a fingerboard secured to a face of said neck adjacent said strings, wherein said fingerboard is made of a single solid piece of a high pressure paper laminate material and said bridge is made of a single solid piece of a high pressure paper laminate material.

12. A musical instrument according to claim 11, wherein said high pressure laminate material is MICARTA.

13. A musical instrument comprising a body with a bridge, an elongate neck with a headstock, and strings extending from said head stock to said bridge along said neck, said bridge being made of a high pressure laminate material.

14. A musical instrument according to claim 13, wherein said neck is made of a solid piece of machined plywood material that is glued with and at least partially impregnated with a phenolic resin.

15. A musical instrument according to claim 14, wherein said plywood material is made of multiple plies of wood, and wherein said plies are substantially parallel to each other and to the strings of the musical instrument and extend substantially perpendicular to a plane common with a face of said neck adjacent said strings.

16. A musical instrument according to claim 14, wherein said plywood material is made from multiple glued together plies of birch wood, and wherein said plies extend substantially continuously throughout the length of the neck.

17. A musical instrument according to claim 13, wherein said instrument body is constructed of a non-wooden high pressure laminate material.

18. A musical instrument according to claim 13, further comprising a fingerboard made of a high pressure laminate material secured to a face of said neck adjacent said strings.

19. A musical instrument according to claim 18, wherein said bridge and said fingerboard are made of the same type of high pressure laminate material.

20. A musical instrument according to claim 18, wherein said high pressure laminate material of said fingerboard and said bridge is MICARTA.

* * * * *